US012173384B2

(12) United States Patent
Luo et al.

(10) Patent No.: US 12,173,384 B2
(45) Date of Patent: Dec. 24, 2024

(54) MAGNESIUM ALLOY BASED OBJECTS AND METHODS OF MAKING AND USE THEREOF

(71) Applicant: Ohio State Innovation Foundation, Columbus, OH (US)

(72) Inventors: Aihua Luo, Westerville, OH (US); Thomas Avey, Columbus, OH (US)

(73) Assignee: Ohio State Innovation Foundation, Columbus, OH (US)

( * ) Notice: Subject to any disclaimer, the term of this patent is extended or adjusted under 35 U.S.C. 154(b) by 27 days.

(21) Appl. No.: 17/637,570

(22) PCT Filed: Aug. 6, 2020

(86) PCT No.: PCT/US2020/045138
§ 371 (c)(1),
(2) Date: Feb. 23, 2022

(87) PCT Pub. No.: WO2021/040988
PCT Pub. Date: Mar. 4, 2021

(65) Prior Publication Data

US 2022/0275477 A1 Sep. 1, 2022

Related U.S. Application Data

(60) Provisional application No. 62/891,572, filed on Aug. 26, 2019.

(51) Int. Cl.
*C22C 1/02* (2006.01)
*C22C 23/00* (2006.01)
(Continued)

(52) U.S. Cl.
CPC ..... *C22C 1/02* (2013.01); *C22C 23/00* (2013.01); *C22C 23/04* (2013.01); *C22F 1/06* (2013.01)

(58) Field of Classification Search
CPC . C22C 1/02; C22C 23/00; C22C 23/04; C22F 1/06
See application file for complete search history.

(56) References Cited

U.S. PATENT DOCUMENTS 6,854,172 B2 2/2005 Kaese et al.
2005/0194072 A1 9/2005 Luo et al.
(Continued)

FOREIGN PATENT DOCUMENTS

CN 101629260 A 1/2010
CN 102505089 A 6/2012
(Continued)

OTHER PUBLICATIONS

International Search Report and Written Opinion, issued by the International Searching Authority (ISA/US) in corresponding PCT Application No. PCT/US2020/045138 on Oct. 29, 2020. 9 pages.
(Continued)

*Primary Examiner* — John A Hevey
(74) *Attorney, Agent, or Firm* — Meunier Carlin & Curfman LLC

(57) ABSTRACT

Disclosed herein are magnesium alloy based objects and methods of making and use thereof. For example, disclosed herein are methods of making a magnesium alloy based object, the methods comprising: heating an object comprising a preliminary magnesium alloy at a first temperature for a first amount of time, the preliminary magnesium alloy comprising a first intermetallic phase, a second intermetallic phase, and an alloy phase, to thereby substantially dissolving the first intermetallic phase into the alloy phase to form an object comprising an intermediate magnesium alloy, the intermediate magnesium alloy comprising the second intermetallic phase and the alloy phase; and heating the object comprising the intermediate magnesium alloy at a second temperature for a second amount of time to thereby sub-
(Continued)

stantially dissolving the second intermetallic phase into the alloy phase and minimizing incipient melting of the alloy phase to form the magnesium alloy based object.

15 Claims, 4 Drawing Sheets

(51) Int. Cl.
*C22C 23/04* (2006.01)
*C22F 1/06* (2006.01)

(56) References Cited

U.S. PATENT DOCUMENTS

| | | | | |
|---|---|---|---|---|
| 2011/0030855 | A1 | 2/2011 | Bharadwaj et al. | |
| 2013/0144290 | A1 | 6/2013 | Schiffl et al. | |
| 2015/0167128 | A1* | 6/2015 | Fine | C22C 21/00 148/420 |
| 2016/0022876 | A1* | 1/2016 | Imwinkelried | C22F 1/06 606/280 |
| 2017/0000925 | A1 | 1/2017 | Imwinkelried et al. | |
| 2019/0001027 | A1 | 1/2019 | Ibrahim et al. | |
| 2022/0341006 | A1* | 10/2022 | Luo | C22F 1/06 |

FOREIGN PATENT DOCUMENTS

| | | | |
|---|---|---|---|
| CN | 106756365 | A | 5/2017 |
| EP | 3395458 | A1 | 10/2018 |
| JP | 2015074787 | A | 4/2015 |
| WO | 2014145672 | A1 | 9/2014 |
| WO | 2017112779 | A1 | 6/2017 |
| WO | 2019164828 | A1 | 8/2019 |

OTHER PUBLICATIONS

Li et al. Corrosion and biocompatibility improvement of magnesium-based alloys as bone implant materials: a review. Regenerative Biomaterials, 2017, 129-137.

Liu et al. Biodegradable Magnesium Alloys Developed as Bone Repair Materials: A Review. Hindawi, Scanning, 2018, 9216314, 15 pages.

Lu et al. Effects of secondary phase and grain size on corrosion of biodegradable Mg—Zn—Ca alloys. Materials Science and Engineering C, 2015, 48, 480-486.

Puigdollers et al. Increasing Oxide Reducibility: The Role of Metal/Oxide interfaces in the Formation of Oxygen Vacancies. ACS Catalysis, 2017, 7, 6493-6513.

Radha et al. Insight of magnesium alloys and composites for orthopedic implant applications—a review. Journal of Magnesium Alloys, 2017, 5, 286-312.

ASTM Standard E112-13—Standard Test Methods for Determining Average Grain Size (28 pages).

European Patent Office. Extended European Search Report. Issued in EP Application No. 20858352.6 on Aug. 25, 2023. 11 pages.

Shi et al. "A new magnesium sheet alloy and its multi-stage homogenization for simultaneously improved ductility and strength at room temperature." Scripta Materialia 171 (2019): 92-97.

* cited by examiner

MAGNESIUM ALLOY BASED OBJECTS AND METHODS OF MAKING AND USE THEREOF

CROSS-REFERENCE TO RELATED APPLICATIONS

This application is a U.S. national stage application filed under 35 U.S.C. § 371 of PCT/US2020/045138 filed Aug. 6, 2020, which claims the benefit of priority to U.S. Provisional Application No. 62/891,572, filed Aug. 26, 2019, each of which is hereby incorporated herein by reference in its entirety.

BACKGROUND

Current, state of the art, bone fixation devices are made of stiffer than bone stainless steels or titanium alloys and are either left indefinitely in the body or removed surgically. Magnesium alloys have shown potential to be a significant improvement to the current technology. Mg has bone-like mechanical properties and can be broken down and processed non-toxically by the body. Currently, Mg from commercial Mg alloys is reabsorbed far quicker than is needed for standard bone healing (2-4 months). This is the result of commercial Mg alloys having been optimized for single properties; either mechanical properties, atmospheric corrosion resistance, or biocompatibility. The properties of many Mg alloys also suffer from the presence of brittle intermetallic phases. Mg alloys with improved properties are needed for many applications. The compositions, methods, and systems discussed herein addresses these and other needs.

SUMMARY

In accordance with the purposes of the disclosed compositions, methods, and systems as embodied and broadly described herein, the disclosed subject matter relates to magnesium alloy based objects and methods of making and use thereof.

For example, disclosed herein are methods of making a magnesium alloy based object, the methods comprising: heating an object comprising a preliminary magnesium alloy at a first temperature for a first amount of time; wherein the preliminary magnesium alloy comprises a first intermetallic phase having a melting temperature, a second intermetallic phase having a melting temperature, and an alloy phase having a solidus temperature; wherein the melting temperature of the first intermetallic phase is lower than the melting temperature of the second intermetallic phase and the solidus temperature of the alloy phase; wherein the melting temperature of the second intermetallic phase is higher than the solidus temperature of the alloy phase; wherein the first temperature is above the melting temperature of the first intermetallic phase, below the melting temperature of the second intermetallic phase, and below the solidus temperature of the alloy phase; thereby substantially dissolving the first intermetallic phase into the alloy phase to form an object comprising an intermediate magnesium alloy, the intermediate magnesium alloy comprising the second intermetallic phase and the alloy phase; and heating the object comprising the intermediate magnesium alloy at a second temperature for a second amount of time; wherein the second temperature is above the melting temperature of the second intermetallic phase; thereby substantially dissolving the second intermetallic phase into the alloy phase and minimizing incipient melting of the alloy phase to form the magnesium alloy based object.

In some examples, the first temperature is from 10° C. to 50° C. above the melting temperature of the first intermetallic phase. In some examples, the first temperature is from 340° C. to 360° C. The first amount of time, in some examples, is from 10 hours to 15 hours.

The second temperature, in some examples, is from 10° C. to 20° C. above the melting temperature of the second intermetallic phase. In some examples, the second temperature is from 430° C. to 450° C. In some examples, the second amount of time is from 1 hour to 5 hours.

The method, in some examples, further comprises determining the first temperature, the first amount of time, the second temperature, the second amount of time, or a combination thereof.

The method, in some examples, further comprises casting the object comprising the preliminary magnesium alloy.

The preliminary magnesium alloy, in some examples, comprises a biocompatible magnesium alloy. In some examples, the preliminary magnesium alloy comprises a Mg—Ca—Zn alloy. In some examples, the preliminary magnesium alloy comprises a Mg—Ca—Mn—Zn alloy. In some examples, the preliminary magnesium alloy is substantially free of rare earth elements.

The first intermetallic phase, in some examples, comprises $Mg_6Ca_2Zn_3$. In some examples, the second intermetallic phase comprises $Mg_2Ca$.

The magnesium alloy based object, in some examples, comprises a substantially homogeneous matrix comprising the alloy phase.

The methods can, in some examples, further comprise thermomechanically treating the magnesium alloy based object by heating the magnesium based object at a third temperature for a third amount of time and, subsequently, mechanically treating the magnesium alloy based object. In some examples, the methods further comprise repeating the thermomechanical treatment.

In some examples, the third temperature is above room temperature and below the solidus temperature. The third temperature, in some examples, is from 10° C. to 50° C. below the solidus temperature. In some examples, the third temperature is from 390° C. to 410° C. The third amount of time is, in some examples, from 1 minute to 1 hour, from 1 minute to 30 minutes, or from 5 minutes to 20 minutes. The methods, in some examples, further comprise determining the third temperature and/or the third amount of time.

Mechanically treating the magnesium alloy based object, in some examples, comprises rolling, extruding, and/or forging the magnesium alloy based object. In some examples, mechanically treating the magnesium alloy based object, in some examples, comprises rolling the magnesium alloy based object. In some examples, the magnesium alloy based object has an average thickness and rolling the magnesium alloy based object reduces the average thickness of the magnesium alloy based object, for example by 1% to 99.8%. In some examples, mechanically treating the magnesium alloy based object comprises extrusion and/or forging.

The magnesium alloy based object, in some examples, exhibits improved mechanical properties after thermomechanical treatment. In some examples, the magnesium alloy based object exhibits improved yield stress and/or ductility after thermomechanical treatment.

Also described herein are magnesium alloy based objects made by any of the methods described herein. The magnesium alloy based object, in some examples, has a yield stress of from 200 to 300 MPa. In some examples, the magnesium alloy based object has a ductility of 8-33%. In some examples, the magnesium alloy based object has an average thickness of from 1 mm to 4 mm. In some examples, the magnesium based alloy has an average grain size of from 10 μm to 15 μm.

Also described herein are methods of use of any of the magnesium alloy based objects made by any of the methods described herein. In some examples, the method comprises using the magnesium alloy based object as a bone fixation device, a load bearing implant, or a combination thereof.

Also described herein are articles of manufacture comprising any of the magnesium alloy based objects made by any of the methods described herein. In some examples, the article of manufacture comprises a bone fixation device, a load bearing implant, or a combination thereof.

Additional advantages of the disclosed compositions, systems, and methods will be set forth in part in the description which follows, and in part will be obvious from the description. The advantages of the disclosed compositions, systems, and methods will be realized and attained by means of the elements and combinations particularly pointed out in the appended claims. It is to be understood that both the foregoing general description and the following detailed description are exemplary and explanatory only and are not restrictive of the disclosed systems and methods, as claimed.

The details of one or more embodiments of the invention are set forth in the accompanying drawings and the description below. Other features, objects, and advantages of the invention will be apparent from the description and drawings, and from the claims.

BRIEF DESCRIPTION OF THE FIGURES

The accompanying figures, which are incorporated in and constitute a part of this specification, illustrate several aspects of the disclosure, and together with the description, serve to explain the principles of the disclosure.

DETAILED DESCRIPTION

Figure 1A:
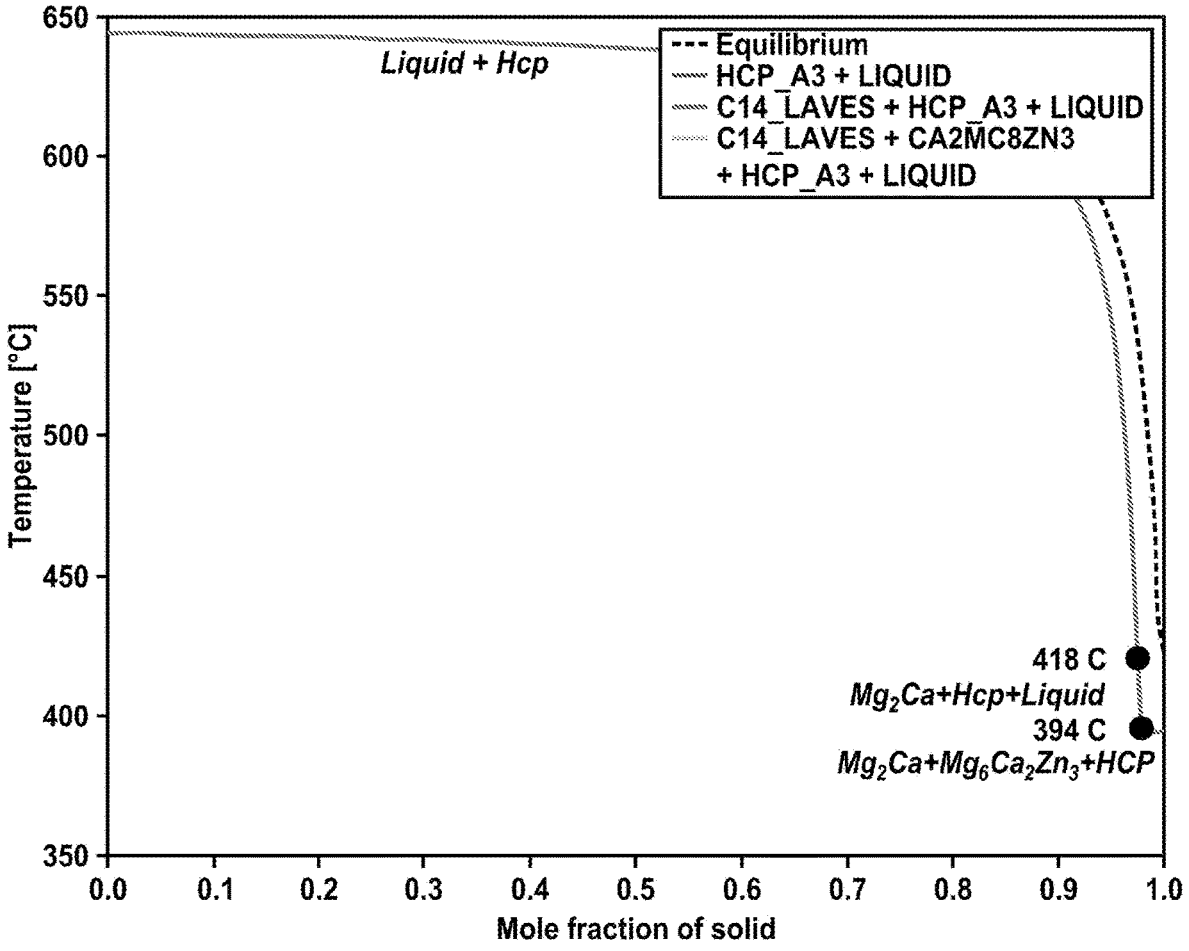
FIG. 1*a* is a solidification model for Mg—Ca—Zn alloy.

The compositions, methods, and systems described herein may be understood more readily by reference to the following detailed description of specific aspects of the disclosed subject matter and the Examples included therein.

Before the present compositions, methods, and systems are disclosed and described, it is to be understood that the aspects described below are not limited to specific synthetic methods or specific reagents, as such may, of course, vary. It is also to be understood that the terminology used herein is for the purpose of describing particular aspects only and is not intended to be limiting.

Also, throughout this specification, various publications are referenced. The disclosures of these publications in their entireties are hereby incorporated by reference into this application in order to more fully describe the state of the art to which the disclosed matter pertains. The references disclosed are also individually and specifically incorporated by reference herein for the material contained in them that is discussed in the sentence in which the reference is relied upon.

In this specification and in the claims that follow, reference will be made to a number of terms, which shall be defined to have the following meanings.

Throughout the description and claims of this specification the word "comprise" and other forms of the word, such as "comprising" and "comprises," means including but not limited to, and is not intended to exclude, for example, other additives, components, integers, or steps.

As used in the description and the appended claims, the singular forms "a," "an," and "the" include plural referents unless the context clearly dictates otherwise. Thus, for example, reference to "a composition" includes mixtures of two or more such compositions, reference to "an agent" includes mixtures of two or more such agents, reference to "the component" includes mixtures of two or more such components, and the like.

"Optional" or "optionally" means that the subsequently described event or circumstance can or cannot occur, and that the description includes instances where the event or circumstance occurs and instances where it does not.

Ranges can be expressed herein as from "about" one particular value, and/or to "about" another particular value. By "about" is meant within 5% of the value, e.g., within 4, 3, 2, or 1% of the value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

It is understood that throughout this specification the identifiers "first" and "second" are used solely to aid in distinguishing the various components and steps of the disclosed subject matter. The identifiers "first" and "second" are not intended to imply any particular order, amount, preference, or importance to the components or steps modified by these terms.

References in the specification and concluding claims to parts by weight of a particular element or component in a composition denotes the weight relationship between the element or component and any other elements or components in the composition or article for which a part by weight is expressed. Thus, in a compound containing 2 parts by weight of component X and 5 parts by weight component Y, X and Y are present at a weight ratio of 2:5, and are present in such ratio regardless of whether additional components are contained in the compound.

A weight percent (wt. %) of a component, unless specifically stated to the contrary, is based on the total weight of the formulation or composition in which the component is included.

Disclosed herein are methods of making magnesium alloy based objects, the methods comprising heating an object comprising a preliminary magnesium alloy. The term "preliminary magnesium alloy" is used herein to refer to a magnesium alloy before it has undergone a heat treatment as disclosed herein. It is not meant to imply that the preliminary magnesium alloy is not yet a magnesium alloy (e.g., a metal element). Rather, a preliminary magnesium alloy is meant to refer to a magnesium alloy that has intermetallic phases present (e.g., 2 or more intermetallic phases). In some examples, the preliminary magnesium alloy comprises a first intermetallic phase, a second intermetallic phase, and an alloy phase. "Phase," as used herein, generally refers to a region of a material having a substantially uniform composition which is a distinct and physically separate portion of a heterogeneous system. The term "phase" does not imply that the material making up a phase is a chemically pure substance, but merely that the chemical and/or physical properties of the material making up the phase are essentially uniform throughout the material, and that these chemical and/or physical properties differ significantly from the chemical and/or physical properties of another phase within the material. Examples of physical properties include density, thickness, aspect ratio, specific surface area, porosity and dimensionality. Examples of chemical properties include chemical composition.

In some examples, the preliminary magnesium alloy comprises a biocompatible magnesium alloy. In some examples, the preliminary magnesium alloy is substantially free of rare earth elements. Examples of suitable preliminary magnesium alloys include, but are not limited to, Mg—Ca—Zn alloys. In some examples, the preliminary magnesium alloy comprises a Mg—Ca—Mn—Zn alloy.

In some examples, the preliminary magnesium alloy comprises a Mg—Ca—Zn alloy, the first intermetallic phase comprises $Mg_6Ca_2Zn_3$, the second intermetallic phase comprises $Mg_2Ca$, or a combination thereof. In some examples, the preliminary magnesium alloy comprises a Mg—Ca—Zn alloy and the first intermetallic phase comprises $Mg_6Ca_2Zn_3$. In some examples, the preliminary magnesium alloy comprises a Mg—Ca—Zn alloy and the second intermetallic phase comprises $Mg_2Ca$. In some examples, the preliminary magnesium alloy comprises a Mg—Ca—Zn alloy, the first intermetallic phase comprises $Mg_6Ca_2Zn_3$, and the second intermetallic phase comprises $Mg_2Ca$.

The first intermetallic phase has a melting temperature, the second intermetallic phase has a melting temperature, and the alloy phase has a solidus temperature; wherein the melting temperature of the first intermetallic phase is lower than the melting temperature of the second intermetallic phase and the solidus temperature of the alloy phase; and wherein the melting temperature of the second intermetallic phase is higher than the solidus temperature of the alloy phase. The methods disclosed herein comprise heating the object comprising a preliminary magnesium alloy at a first temperature for a first amount of time; wherein the first temperature is above the melting temperature of the first intermetallic phase, below the melting temperature of the second intermetallic phase, and below the solidus temperature of the alloy phase.

The first temperature can, for example, be above the melting temperature of the first intermetallic phase by 10° C. or more (e.g., 15° C. or more, 20° C. or more, 25° C. or more, 30° C. or more, 35° C. or more, or 40° C. or more). In some examples, the first temperature can be above the melting temperature of the first intermetallic phase by 50° C. or less (e.g., 45° C. or less, 40° C. or less, 35° C. or less, 30° C. or less, 25° C. or less, or 20° C. or less). The first temperature can be above the melting temperature of the first intermetallic phase by an amount that ranges from any of the minimum values described above to any of the maximum values described above. For example, the first temperature can be from 10° C. to 50° C. above the melting temperature of the first intermetallic phase (e.g., from 10° C. to 30° C., from 30° C. to 50° C., from 10° C. to 20° C., from 20° C. to 30° C., from 30° C. to 40° C., from 40° C. to 50° C., from 10° C. to 40° C., from 20° C. to 50° C., from 1.5° C. to 45° C., or from 20° C. to 40° C.). In some examples, the preliminary magnesium alloy comprises a Mg—Ca—Zn alloy, the first intermetallic phase comprises $Mg_6Ca_2Zn_3$, the second intermetallic phase comprises $Mg_2Ca$, and the first temperature is from 10° C. to 50° C. above the melting temperature of the first intermetallic phase.

In some examples, the first temperature can be 340° C. or more (e.g., 345° C. or more, 350° C. or more, or 355° C. or more in some examples, the first temperature can be 360° C. or less (e.g., 355° C. or less, 350° C. or less, or 345° C. or less). The first temperature can range from any of the minimum values described above to any of the maximum values described above. For example, the first temperature can be from 340° C. to 360° C. (e.g., from 340° C. to 350° C., from 350° C. to 360° C., or from 345° C. to 355° C.). In some examples, the preliminary magnesium alloy comprises a Mg—Ca—Zn alloy, the first intermetallic phase comprises $Mg_6Ca_2Zn_3$, the second intermetallic phase comprises $Mg_2Ca$, and the first temperature is from 340° C. to 360° C. In some examples, the first temperature is from 10° C. to 50° C. above the melting temperature of the first intermetallic phase and the first temperature is from 340° C. to 360° C.

The first amount of time can, for example, be 10 hours or more (e.g., 10.5 hours or more, 11 hours or more, 11.5 hours or more, 12 hours or more, 12.5 hours or more, 13 hours or more, 13.5 hours or more, or 14 hours or more). In some examples, the first amount of time can be 15 hours or less (e.g., 14.5 hours or less, 14 hours or less, 13.5 hours or less, 13 hours or less, 12.5 hours or less, 12 hours or less, 11.5 hours or less, or 11 hours or less). The first amount of time can range from any of the minimum values described above to any of the maximum values described above. For examples, the first amount of time can be from 10 hours to 15 hours (e.g., from 10 hours to 12.5 hours, from 12.5 hours to 15 hours, from 10 hours to 11 hours, from 11 hours to 12 hours, from 12 hours to 13 hours, from 13 hours to 14 hours, from 14 hours to 15 hours, from 10 hours to 14 hours, from 11 hours to 15 hours, or from 11 hours to 14 hours). In some examples, the preliminary magnesium alloy comprises a Mg—Ca—Zn alloy, the first intermetallic phase comprises $Mg_6Ca_2Zn_3$, the second intermetallic phase comprises $Mg_2Ca$, and the first amount of time is from 10 hours to 15 hours.

In some examples, the first temperature is from 10° C. to 50° C. above the melting temperature of the first intermetal lie phase and the first amount of time is from 10 hours to 15 hours. In some examples, the preliminary magnesium alloy comprises a Mg—Ca—Zn alloy, the first intermetallic phase comprises $Mg_6Ca_2Zn_3$, the second intermetallic phase comprises $Mg_2Ca$, the first temperature is from 10° C. to 50° C. above the melting temperature of the first intermetal lie phase, and the first amount of time is from 10 hours to 15 hours. In some examples, the first temperature is from 340° C. to 360° C. and the first amount of time is from 10 hours to 15 hours. In some examples, the preliminary magnesium alloy comprises a Mg—Ca—Zn alloy, the first intermetallic phase comprises $Mg_6Ca_2Zn_3$, the second intermetallic phase comprises $Mg_2Ca$, the first temperature is from 340° C. to 360° C., and the first amount of time is from 10 hours to 15 hours. In some examples, the first temperature is from 10° C. to 50° C. above the melting temperature of the first intermetallic phase, the first temperature is from 340° C. to 360° C., and the first amount of time is from 10 hours to 15 hours. In some examples, the preliminary magnesium alloy comprises a Mg—Ca—Zn alloy, the first intermetallic phase comprises $Mg_6Ca_2Zn_3$, the second intermetallic phase comprises $Mg_2Ca$, the first temperature is from 10° C. to 50° C. above the melting temperature of the first intermetallic phase, the first temperature is from 340° C. to 360° C., and the first amount of time is from 10 hours to 15 hours.

The first temperature and/or the first amount of time can be selected in view of a variety of factors. For example, the first temperature and the first amount of time can be selected such that heating the object comprising the preliminary magnesium alloy at the first temperature for the first amount of time substantially dissolves the first intermetallic phase into the alloy phase. In some examples, the methods can further comprise determining the first temperature and/or the first amount of time at which to heat the object comprising the preliminary magnesium alloy to thereby substantially dissolve the first intermetallic phase into the alloy phase.

The methods disclosed herein comprise heating the object comprising a preliminary magnesium alloy at the first temperature for the first amount of time; wherein the first temperature is above the melting temperature of the first intermetallic phase, below the melting temperature of the second intermetallic phase, and below the solidus temperature of the alloy phase; thereby substantially dissolving the first intermetallic phase into the alloy phase to form an object comprising an intermediate magnesium alloy, the intermediate magnesium alloy comprising the second intermetallic phase and the alloy phase. The methods further comprise heating the object comprising the intermediate magnesium alloy at a second temperature for a second amount of time, wherein the second temperature is above the melting temperature of the second intermetallic phase.

The second temperature can, for example, be above the melting temperature of the second intermetallic phase by 10° C. or more (e.g., 11° C. or more, 12° C. or more 13° C. or more, 14° C. or more, 15° C. or more, 16° C. or more, 17° C. or more, or 18° C. or more). In some examples, the second temperature can be above the melting temperature of the second intermetallic phase by 20° C. or less (e.g., 19° C. or less, 18° C. or less, 17° C. or less, 16° C. or less, 15° C. or less, 14° C. or less, 13° C. or less, or 12° C. or less). The second temperature can be above the melting temperature of the second intermetallic phase by an amount that ranges from any of the minimum values described above to any of the maximum values described above. For example, the second temperature can be from 10° C. to 20° C. above the melting temperature of the second intermetallic phase (e.g., from 10° C. to 15° C., from 15 to 20° C., from 10° C. to 12° C., from 12° C. to 14° C., from 14° C. to 16° C., from 16° C. to 18° C., from 18° C. to 20° C., from 12° C. to 20° C., from 10° C. to 18° C., or from 12° C. to 18° C.). In some examples, the preliminary magnesium alloy comprises a Mg—Ca—Zn alloy, the first intermetallic phase comprises $Mg_6Ca_2Zn_3$, the second intermetallic phase comprises $Mg_2Ca$, and the second temperature is from 10° C. to 20° C. above the melting temperature of the second intermetallic phase.

In some examples, the second temperature is 430° C. or more (e.g., 435° C. or more, 440° C. or more, or 445° C. or more). In some examples, the second temperature is 450° C. or less (e.g., 445° C. or less, 440° C. or less, or 435° C. or less). The second temperature can range from any of the minimum values described above to any of the maximum values described above. For example, the second temperature can be from 430° C. to 450° C. (e.g., from 430° C. to 440° C., from 44° C. to 450° C., or from 435° C. to 445° C.). In some examples, the preliminary magnesium alloy comprises a Mg—Ca—Zn alloy, the first intermetallic phase comprises $Mg_6Ca_2Zn_3$, the second intermetallic phase comprises $Mg_2Ca$, and the second temperature is from 430° C. to 450° C. In some examples, the second temperature is from 10° C. to 20° C. above the melting temperature of the second intermetallic phase, and the second temperature is from 430° C. to 450° C.

The second amount of time can, for example, be 1 hour or more (e.g., 1.5 hours or more, 2 hours or more, 2.5 hours or more, 3 hours or more, 3.5 hours or more, or 4 hours or more). In some examples, the second amount of time can be 5 hours or less (e.g., 4.5 hours or less, 4 hours or less, 3.5 hours or less, 3 hours or less, 2.5 hours or less, or 2 hours or less). The second amount of time can range from any of the minimum values described above to any of the maximum values described above. For example, the second amount of time can be from 1 hour to 5 hours (e.g., from 1 hour to 3 hours, from 3 hours to 5 hours, from 1 hour to 2 hours, from 2 hours to 3 hours, from 3 hours to 4 hours, from 4 hours to 5 hours, from 1 hour to 4 hours, from 2 hours to 5 hours, or from 2 hours to 4 hours). In some examples, the preliminary magnesium alloy comprises a Mg—Ca—Zn alloy, the first intermetallic phase comprises $Mg_6Ca_2Zn_3$, the second intermetallic phase comprises $Mg_2Ca$, and the second amount of time is from 1 hour to 5 hours.

In some examples, the second temperature is from 10° C. to 20° C. above the melting temperature of the second intermetallic phase and the second amount of time is from 1 hour to 5 hours. In some examples, the preliminary magnesium alloy comprises a Mg—Ca—Zn alloy, the first intermetallic phase comprises $Mg_6Ca_2Zn_3$, the second intermetallic phase comprises $Mg_2Ca$, the second temperature is from 10° C. to 20° C. above the melting temperature of the second intermetallic phase, and the second amount of time is from 1 hour to 5 hours. In some examples, the first temperature is from 10° C. to 50° C. above the melting temperature of the first intermetallic phase, the first amount of time is from 10 hours to 15 hours, the second temperature is from 10° C. to 20° C. above the melting temperature of the second intermetallic phase, and the second amount of time is from 1 hour to 5 hours. In some examples, the preliminary magnesium alloy comprises a Mg—Ca—Zn alloy, the first intermetallic phase comprises $Mg_6Ca_2Zn_3$, the second intermetallic phase comprises $Mg_2Ca$, the first temperature is from 10° C. to 50° C. above the melting temperature of the first intermetallic phase, the first amount of time is from 10 hours to 15 hours, the second temperature is from 10° C. to 20° C. above the melting temperature of the second intermetallic phase, and the second amount of time is from 1 hour to 5 hours. In some examples, the second temperature is from 430° C. to 450° C. and the second amount of time is from 1 hour to 5 hours. In some examples, the preliminary magnesium alloy comprises a Mg—Ca—Zn alloy, the first intermetallic phase comprises $Mg_6Ca_2Zn_3$, the second intennetallic phase comprises $Mg_2Ca$, the second temperature is from 430° C. to 450° C., and the second amount of time is from 1 hour to 5 hours. In some examples, the first temperature is from 340° C. to 360° C. and the first amount of time is from 10 hours to 15 hours, the second temperature is from 430° C. to 450° C., and the second amount of time is from 1 hour to 5 hours. In some examples, the preliminary magnesium alloy comprises a Mg—Ca—Zn alloy, the first intermetallic phase comprises $Mg_6Ca_2Zn_3$, the second intermetallic phase comprises $Mg_2Ca$, the first temperature is from 340° C. to 360° C. and the first amount of time is from 10 hours to 15 hours, the second temperature is from 430° C. to 450° C., and the second amount of time is from 1 hour to 5 hours.

The second temperature and/or the second amount of time can be selected in view of a variety of factors. For example the second temperature and the second amount of time can be selected such that heating the object comprising the intermediate magnesium alloy at the second temperature for the second amount of time substantially dissolves the second intermetallic phase into the alloy phase and minimizes incipient melting of the alloy phase. In some examples, the methods can further comprise determining the second temperature and/or the second amount of time at which to heat the object comprising the intermediate magnesium alloy to thereby substantially dissolve the second intermetallic phase into the alloy phase and minimize incipient melting of the alloy phase.

The methods further comprise heating the object comprising the intermediate magnesium alloy at the second temperature for the second amount of time, wherein the second temperature is above the melting temperature of the second intermetallic phase, thereby substantially dissolving the second intermetallic phase into the alloy phase and minimizing incipient melting of the alloy phase to form the magnesium alloy based object. As used herein "minimizing" incipient melting of the alloy phase means that 5% or less of the alloy phase melts (e.g., 4.5% or less, 4% or less, 3.5% or less, 3% or less, 2.5% or less, 2% or less, 1.5% or less, 1% or less, 0.5% or less, or 0.1% or less). In some examples, the magnesium alloy based object can comprise a substantially homogeneous matrix comprising the alloy phase.

In some examples, the methods can further comprise thermomechanically treating the magnesium alloy based object by heating the magnesium based object at a third temperature for a third amount of time and, subsequently, mechanically treating the magnesium alloy based object. In some examples, mechanically treating the magnesium alloy based object comprises rolling the magnesium alloy based object, extrusion, forging (e.g., open-die forging and/or closed-die forging), or a combination thereof. In some examples, mechanically treating the magnesium alloy based object comprises rolling the magnesium alloy based object. In some examples, mechanically treating the magnesium alloy based object comprises extrusion. In some examples, mechanically treating the magnesium alloy based object comprises forging (e.g., open-die forging and/or closed-die forging). In some examples, the methods can further comprise repeating the thermomechanical treatment.

The third amount of time can, for example, be 1 minute or more (e.g., 2 minutes or more, 3 minutes or more, 4 minutes or more, 5 minutes or more, 6 minutes or more, 7 minutes or more, 8 minutes or more, 9 minutes or more, 10 minutes or more, 11 minutes or more, 12 minutes or more, 13 minutes or more, 14 minutes or more, 15 minutes or more, 16 minutes or more, 17 minutes or more, 18 minutes or more, 19 minutes or more, 20 minutes or more, 25 minutes or more, 30 minutes or more, 35 minutes or more, 40 minutes or more, 45 minutes or more, or 50 minutes or more). In some examples, the third amount of time can be an hour or less (e.g., 55 minutes or less, 50 minutes or less, 45 minutes or less, 40 minutes or less, 35 minutes or less, 30 minutes or less, 25 minutes or less, 20 minutes or less, 19 minutes or less, 18 minutes or less, 17 minutes or less, 16 minutes or less, 15 minutes or less, 14 minutes or less, 13 minutes or less, 12 minutes or less, 11 minutes or less, 10 minutes or less, 9 minutes or less, 8 minutes or less, 7 minutes or less, 6 minutes or less, or 5 minutes or less). The third amount of time can range from any of the minimum values described above to any of the maximum values described above. For example, the third amount of time can be from 1 minute to 1 hour (e.g., from 1 minute to 30 minutes, from 1 minute to 60 minutes, from 1 minute to 20 minutes, from 20 minutes to 40 minutes, from 40 minutes to 60 minutes, from 1 minute to 50 minutes, from 5 minutes to 60 minutes, from 5 minutes to 50 minutes, or from 5 minutes to 20 minutes).

The third temperature can, for example, be above room temperature and below the solidus temperature. In some examples, the third temperature can be below the solidus temperature by 10° C. or more (e.g., 15° C. or more, 20° C. or more, 25° C. or more, 30° C. or more, 35° C. or more, or 40° C. or more). In some examples, the third temperature can be below the solidus temperature by 50° C. or less (e.g., 45° C. or less, 40° C. or less, 35° C. or less, 30° C. or less, 25° C. or less, or 20° C. or less). The third temperature can be below the solidus temperature by an amount that ranges from any of the minimum values described above to any of the maximum values described above. For example, the third temperature can be from 10° C. to 50° C. below the solidus temperature (e.g., from 10° C. to 30° C., from 30° C. to 50° C., from 10° C. to 20° C., from 20° C. to 30° C., from 30° C. to 40° C., from 40° C. to 50° C., from 10° C. to 40° C., from 20° C. to 50° C., from 15° C. to 45° C., or from 20° C. to 40° C.).

In some examples, the third temperature can be 390° C. or more (e.g., 395° C. or more, 400° C. or more, or 405° C. or more). In some examples, the third temperature can be 410° C. or less (e.g., 405° C. or less, 400° C. or less, or 395° C. or less). The third temperature can range from any of the minimum values described above to any of the maximum values described above. For example, the third temperature can be from 390° C. to 410° C. (e.g., from 390° C. to 400° C., from 400° C. to 410° C., or from 395° C. to 405° C.). In some examples, the third temperature is from 10° C. to 50° C. below the solidus temperature and the third temperature is from 390° C. to 410° C. In some examples, the methods can further comprise determining the third temperature and/or the third amount of time.

In some examples, mechanically treating the magnesium alloy based object comprises rolling the magnesium alloy based object. For example, the magnesium alloy based object can have an average thickness and rolling the magnesium alloy based object can reduce the average thickness of the magnesium alloy based object.

In some examples, rolling the magnesium alloy based object can reduce the average thickness of the magnesium alloy based object by 1% or more (e.g., 5% or more, 10% or more, 15% or more, 20% or more, 25% or more, 30% or more, 35% or more, 40% or more, 45% or more, 50% or more, 55% or more, 60% or more, 65% or more, 70% or more, 75% or more, 80% or more, 85% or more, 90% or more, 95% or more, or 99% or more). In some examples, rolling the magnesium alloy based object can reduce the average thickness of the magnesium alloy based object by 99.8% or less (e.g., 99% or less, 95% or less, 90% or less, 85% or less, 80% or less, 75% or less, 70% or less, 65% or less, 60% or less, 55% or less, 50% or less, 45% or less, 40% or less, 35% or less, 30% or less, 25% or less, 20% or less, 15% or less, 10% or less, or 5% or less). The amount that the average thickness of the magnesium alloy is reduced can range from any of the minimum values described above to any of the maximum values described above. For example, rolling the magnesium alloy based object can reduce the average thickness of the magnesium alloy based object by from 1% to 99.8% (e.g., from 1% to 50%, from 50% to 99.8%, from 1% to 20%, from 20% to 60%, from 60% to 80%, from 80% to 99.8%, from 10% to 99.8%, from 1% to 90%, or from 10% to 90%).

In some examples, the magnesium alloy based object exhibits improved mechanical properties e.g., improved yield stress and/or ductility) after thermomechanical treatment.

In some examples, the methods can further comprise determining the first temperature, the first amount of time, the second temperature, the second amount of time, the third temperature, the third amount of time, or a combination thereof. For example, determining the first temperature, the first amount of time, the second temperature, the second amount of time, the third temperature, the third amount of time, or a combination thereof can be carried out in whole or in part on one or more computing device(s).

In some examples, the methods can further comprise casting the object comprising the preliminary magnesium alloy.

Also disclosed herein are magnesium alloy based objects made by any of the methods described herein. In some examples, the magnesium alloy based objects can comprise a substantially homogeneous matrix comprising the alloy phase.

In some examples, the magnesium alloy based object exhibits a yield stress of 200 MPa or more (e.g., 210 MPa or more, 220 MPa or more, 230 MPa or more, 240 MPa or more, 250 MPa or more, 260 MPa or more, 270 MPa or more, 280 MPa or more, or 290 MPa or more). In some examples, the magnesium alloy based object exhibits a yield stress of 300 MPa or less (e.g., 290 MPa or less, 280 MPa or less, 270 MPa. or less, 260 MPa or less, 250 MPa or less, 240 MPa or less, 230 MPa or less, 220 MPa or less, or 210 MPa or less). The yield stress exhibited by the magnesium alloy based object can range from any of the minimum values described above to any of the maximum values described above. For example, the magnesium alloy based object can exhibit a yield stress of from 200 MPa to 300 MPa (e.g., from 200 MPa to 250 MPa, from 25 MPa 0 to 300 MPa, from 200 MPa to 220 MPa, from 220 MPa to 240 MPa, from 240 MPa to 260 MPa, from 260 MPa to 280 MPa, from 280 MPa to 300 MPa, from 220 MPa to 300 MPa, from 200 MPa to 280 MPa, or from 220 MPa to 280 MPa). As used herein, the yield stress is determined by measurement on a Tensile frame (MTS brand Criterion Model 43) with a laser extensometer (EIR Le-01); the machine produced a Stress vs. Strain plot that includes yield stress, Ultimate Tensile stress, and amount of strain at fracture which can be converted to ductility.

In some examples, the magnesium alloy based object exhibits a ductility of 8% or more (e.g., 10% or more, 15% or more, 20% or more, 25% or more, or 30% or more). In some examples, the magnesium alloy based object exhibits a ductility of 33% or less (e.g., 30% or less, 25% or less, 20% or less, 15% or less, or 10% or less). The ductility exhibited by the magnesium alloy based object can range from any of the minimum values described above to any of the maximum values described above. For example, the magnesium alloy based object can exhibit a ductility of from 8% to 33% (e.g., from 8% to 20%, from 20% to 33%, from 8% to 15%, from 15% to 25%, from 25% to 33%, from 10% to 33%, from 8% to 30%, or from 10% to 30%). As used herein, the ductility is determined by measurement on a Tensile frame (MTS brand Criterion Model 43) with a laser extensorneter (EIR Le-01); the machine produced a Stress vs. Strain plot that includes yield stress, Ultimate Tensile stress, and amount of strain at fracture which can be converted to ductility.

In some examples, the magnesium alloy based object can have an average thickness of 1 mm or more (e.g., 1.5 mm or more, 2 mm or more, 2.5 mm or more, 3 mm or more, or 3.5 mm or more). In some examples, the magnesium alloy based object can have an average thickness of 4 mm or less (e.g., 3.5 mm or less, 3 mm or less, 2.5 mm or less, 2 mm or less, or 1.5 mm or less). The average thickness of the magnesium alloy based object can range from any of the minimum values described above to any of the maximum values described above. For example, the magnesium alloy based object can have an average thickness of from 1 mm to 4 mm (e.g., from 1 mm to 2.5 mm, from 2.5 mm to 4 mm, from 1 mm to 2 mm, from 2 mm to 3 mm, from 3 mm to 4 mm, from 1 mm to 3 mm, from 2 mm to 4 mm or from 1.5 mm to 3.5 mm). As used herein, average thickness is measured using calipers (e.g., digital calipers).

The magnesium based alloy can, for example, have an average grain size of 10 μm or more (e.g., 10.5 μm or more, 11 μm or more, 11.5 μm or more, 12 μm or more, 12.5 μm or more, 13 μm or more, 13.5 μm or more, or 14 μm or more). In some examples, the magnesium based alloy can have an average grain size of 15 μm or less (e.g., 14.5 μm or less, 14 μm or less, 13.5 μm or less, 13 μm or less, 12.5 μm or less, 12 μm or less, 11.5 μm or less, or 11 μm or less), The average grain size of the magnesium based alloy can range from any of the minimum values described above to any of the maximum values described above. For example, the magnesium based alloy can have an average grain size of from 10 μm to 15 μm (e.g., from 10 μm to 12.5 μm, from 12.5 μm to 15 μm, from 10 μm to 11 μm, from 11 μm to 12 μm, from 12 μm to 13 μm, from 13 μm to 14 μm from 14 μm to 15 μm, from 10 μm to 14 μm, from 11 μm to 15 μm, or from 11 μm to 14 μm). As used herein, average grain size is measured using ASTM Standard. E112-13, section 12, General intercept method.

Also disclosed herein are methods of use of any of the magnesium alloy based objects made by any of the methods described herein. For example, the methods of use can comprise using the magnesium alloy based object as a bone fixation device, a load bearing implant, or a combination thereof.

Also disclosed herein are articles of manufacture comprising any of the magnesium alloy based objects made by any of the methods described herein. For example, the article of manufacture can comprise a bone fixation device, a load beating implant, or a combination thereof.

A number of embodiments of the invention have been described. Nevertheless, it will be understood that various modifications may be made without departing from the spirit and scope of the invention. Accordingly, other embodiments are within the scope of the following claims.

The examples below are intended to further illustrate certain aspects of the systems and methods described herein, and are not intended to limit the scope of the claims.

EXAMPLES

The following examples are set forth below to illustrate the methods and results according to the disclosed subject matter. These examples are not intended to be inclusive of all aspects of the subject matter disclosed herein, but rather to illustrate representative methods and results. These examples are not intended to exclude equivalents and variations of the present invention which are apparent to one skilled in the art.

Efforts have been made to ensure accuracy with respect to numbers (e.g., amounts, temperature, etc.) but some errors and deviations should be accounted for. Unless indicated otherwise, parts are parts by weight, temperature is in ° C. or is at ambient temperature, and pressure is at or near atmospheric. There are numerous variations and combinations of measurement conditions, e.g., component concentrations, temperatures, pressures and other measurement ranges and conditions that can be used to optimize the described process.

Example 1

Current, state of the art, bone fixation devices are made of stiffer than bone stainless steels or titanium alloys and are either left indefinitely in the body or removed surgically. Magnesium alloys have shown potential to be a significant improvement to the current technology. Previous work has found that the Mg—Ca—Zn system improves the corrosion resistance in simulated body fluid without sacrificing mechanical strength or biocompatibility.

Described herein are methods that combine alloying with thermomechanical processing in order to improve the mechanical properties of Mg alloys. Mn addition to the Mg—Ca—Zn system was found to improve the formability due to a grain refinement effect. After casting the Mg—Ca—Mn—Zn alloy, a multi-step solution heat treatment was conducted to promote dissolution of brittle intertnetallics. The solution heat treatment was constructed with the help of CALculation of PHAse Diagrams (CALPHAD) software to find temperatures to maximize dissolution and minimize incipient melting.

Figure 1B:
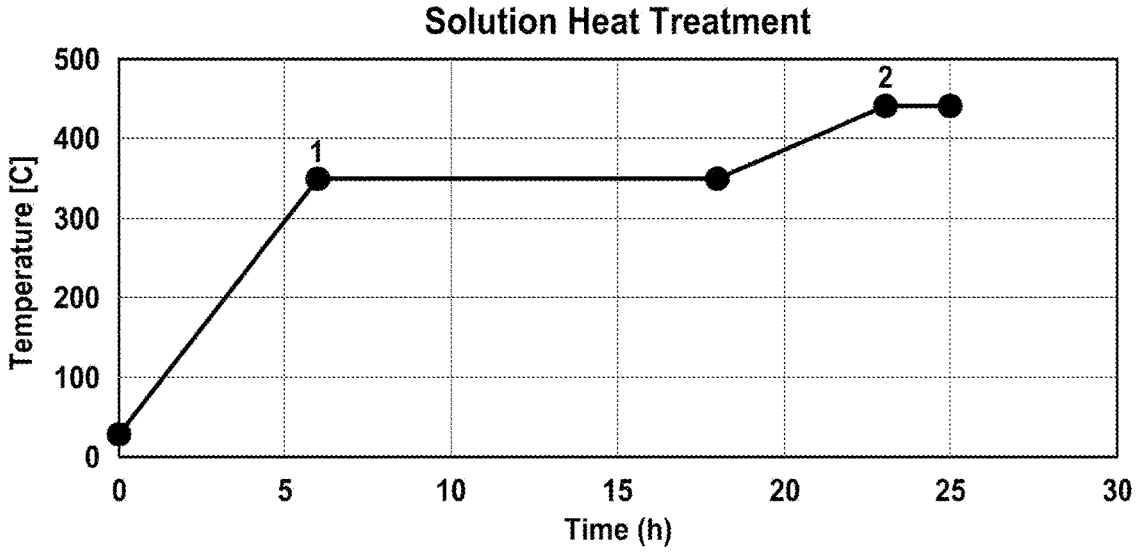
FIG. 1*b* is a multi-stage solution heat treatment schedule for the Mg—Ca—Zn alloy.
Figure 1C:
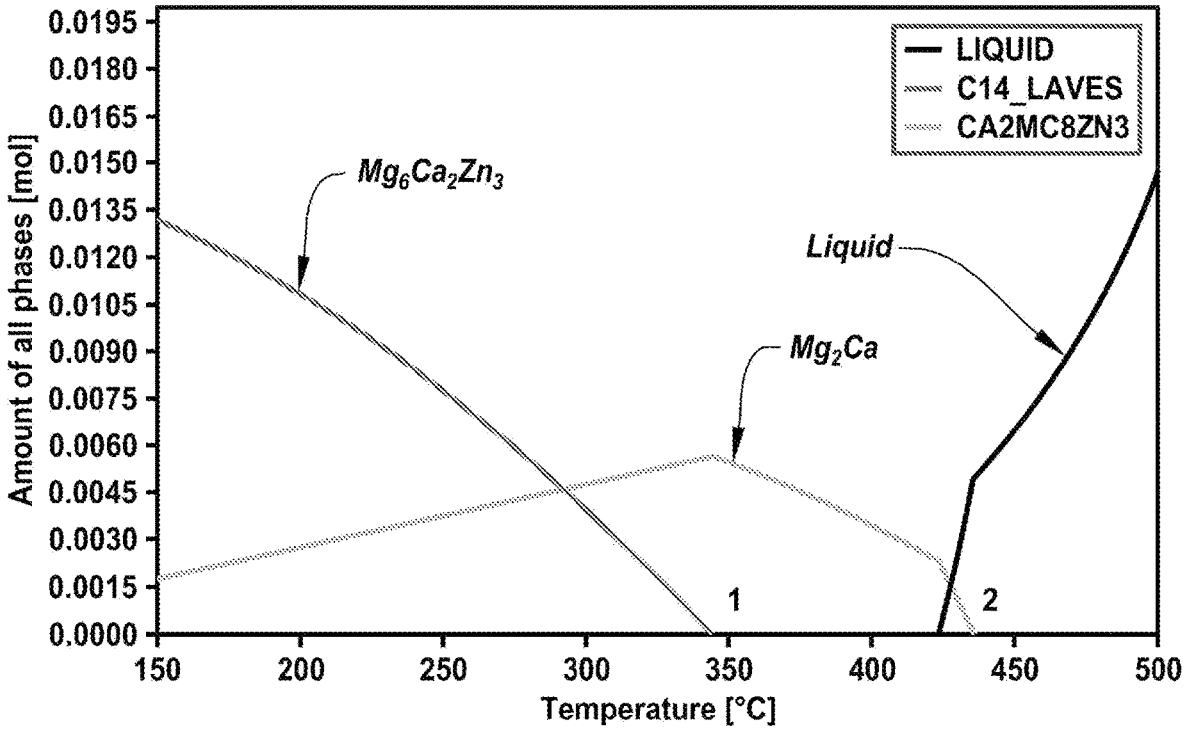
FIG. 1*c* is a phase fraction vs temperature plot for the Mg—Ca—Zn alloy.
Figure 2:
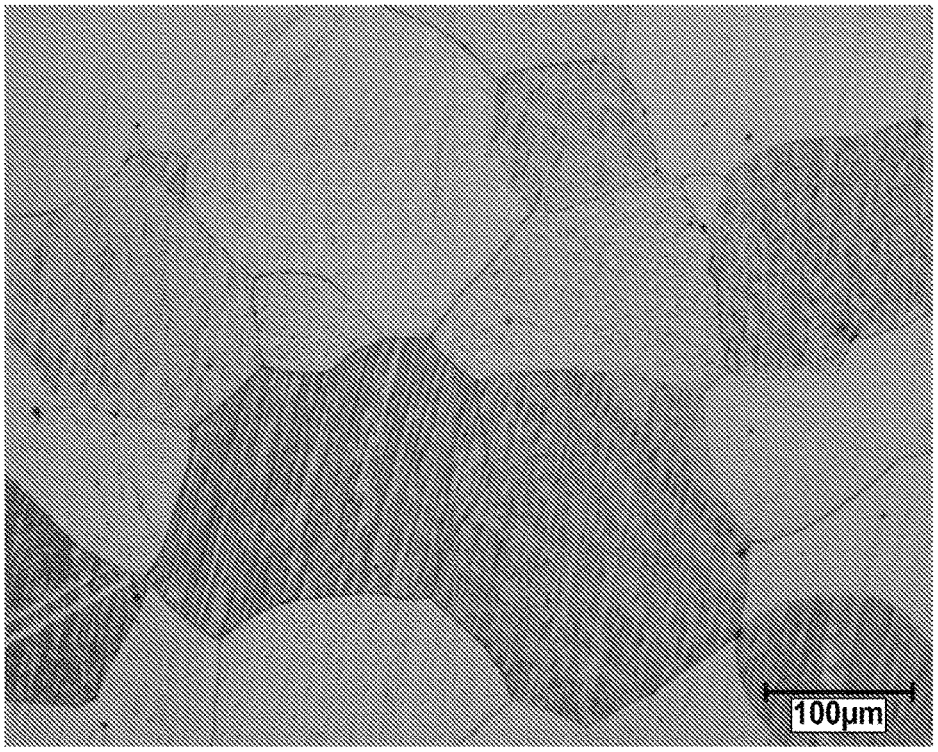
FIG. 2 shows the microstructure of the Mg—Ca—Zn alloy after the multi-stage solution heat treatment.

CALPHAD calculations allow for greater control of homogenization, especially in systems where secondary phases are stable at higher temperatures then the solidus. FIG. 1*a*-FIG. 1*c* shows a phase fraction vs temperature plot for the Mg—Ca—Zn alloy and the multi-stage solution heat treatment that it created. Using a multi stage approach allows for less time to be spent above the solidus temperature while still achieving a homogeneous matrix as seen in FIG. 2.

After the solution heat treatment, further warm rolling was used, which improved strength. Rolling at elevated temperatures was more effective than room temperature. The temperature and heat time were selected to improve rollability without allowing the interrnetallics to reform.

Figure 3:
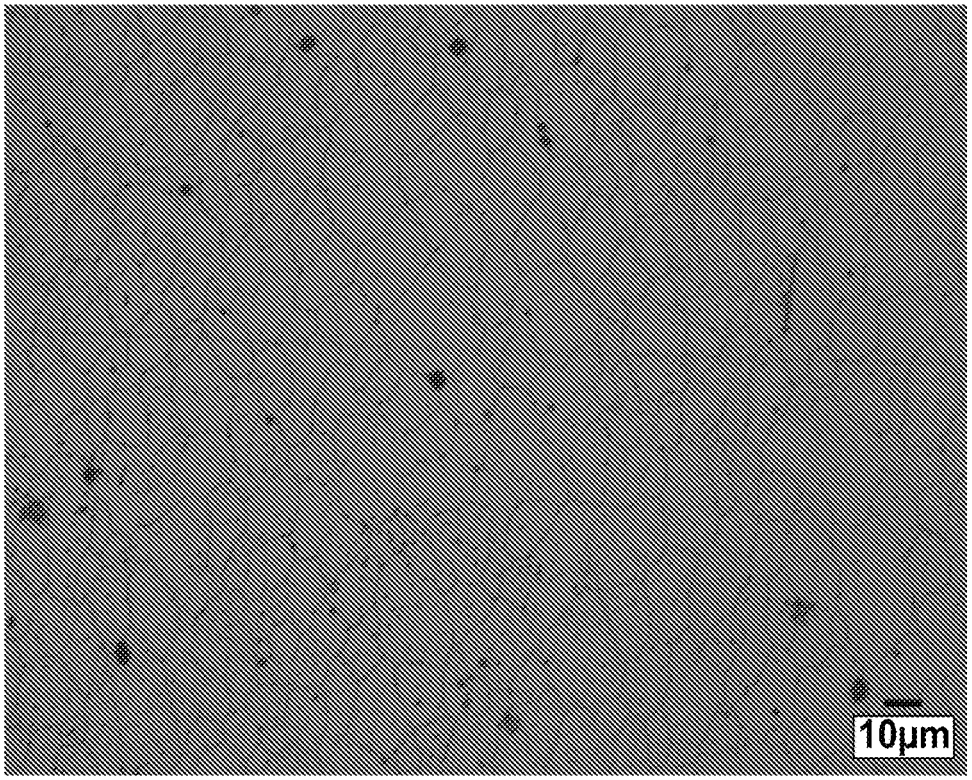
FIG. 3 is an optical micrograph of the Mg—Ca—Zn alloy after warm rolling at 400° C. to reduce the average thickness from 5 mm to 1 mm.

Rolling at elevated temperatures reduces cracking and shattering of samples. By using CALPHAD the maximum rolling temperature can be selected, Using the Phase Fraction vs Temperature plot in FIG. 1*c* as an example, the highest temperature rolling can be performed is the solidus (~425° C.). This is due to incipient melting and solidifying resulting in increased brittleness. The rolling temperature for this test was selected to be 400° C. and short re-heating times (~5 min) were used between passes. The first few passes were very low thickness reduction (~1%) and were slowly ramped up to a maximum of 10% per pass until the samples reached their desired thickness or percent worked. FIG. 3 shows the microstructure after rolling from 5 mm to 1 mm (99.8% reduction).

Figure 4:
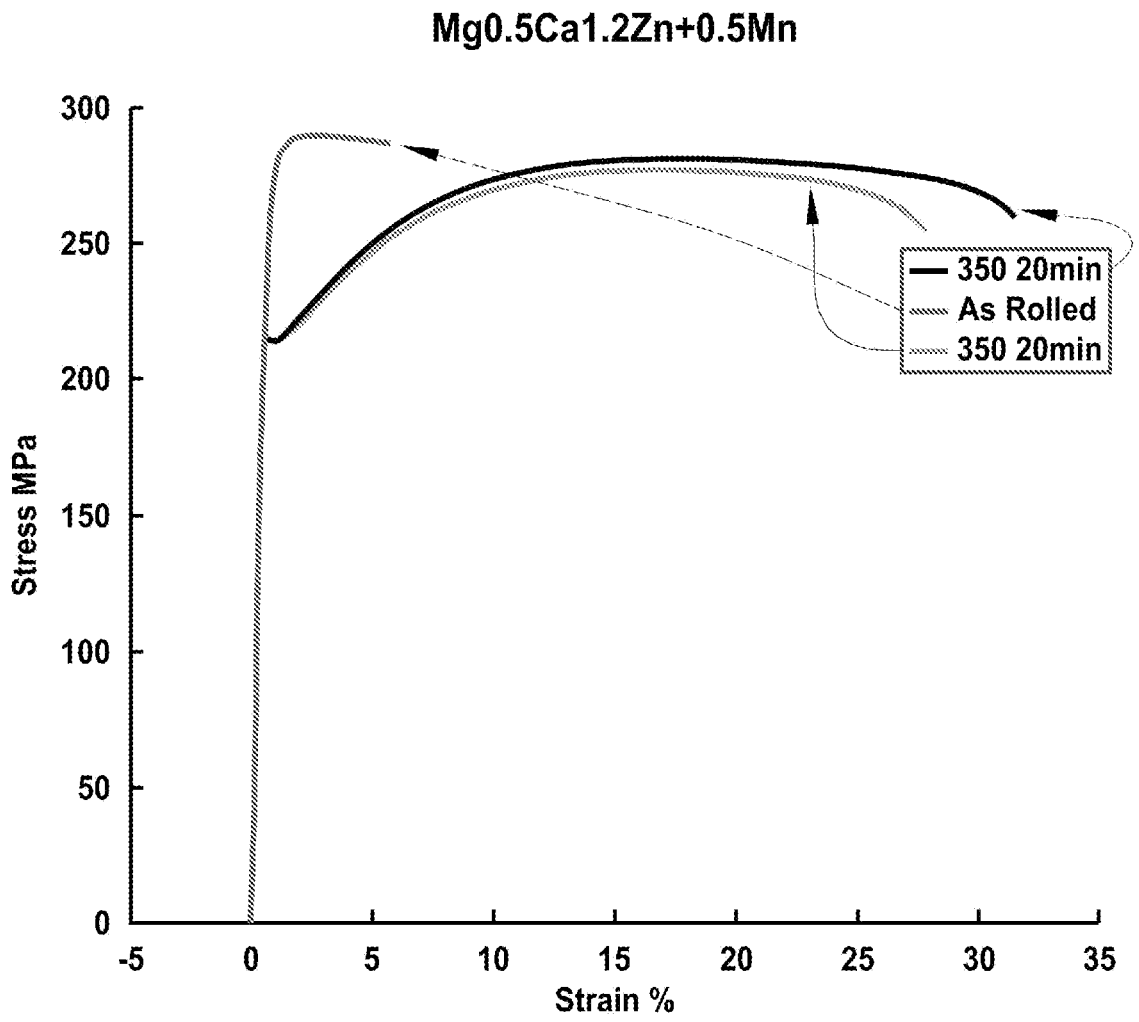
FIG. 4 is a tensile plot of the Mg—Ca—Zn alloy showing as-rolled and as-annealed conditions.

After multi stage solution heat treatment and rolling, the Mg—Ca—Zn alloy exhibited high yield stresses (200-300 MPa) and ductility (8%-33%), depending on processing. FIG. 4 is a tensile curve of a Mg—Ca—Zn alloy as rolled and after annealing at 350° C. for 20 min.

The Mg alloys described herein can, for example, be substantially free of rare earth alloying elements. In some examples, the Mg alloys can include only elements where the elements and their corrosion products are bio-compatible. The methods described herein can be used to strengthen biocompatible Mg alloys, which can for example be used to fabricate surgery free, temporary skeletal fixation devices and/or temporary load bearing implants.

Other advantages which are obvious and which are inherent to the invention will be evident to one skilled in the art. It will be understood that certain features and sub-combinations are of utility and may be employed without reference to other features and sub-combinations. This is contemplated by and is within the scope of the claims. Since many possible embodiments may be made of the invention without departing from the scope thereof, it is to be understood that all matter herein set forth or shown in the accompanying drawings is to be interpreted as illustrative and not in a limiting sense.

The methods of the appended claims are not limited in scope by the specific methods described herein, which are intended as illustrations of a few aspects of the claims and any methods that are functionally equivalent are intended to fall within the scope of the claims. Various modifications of the methods in addition to those shown and described herein are intended to fall within the scope of the appended claims. Further, while only certain representative method steps disclosed herein are specifically described, other combinations of the method steps also are intended to fall within the scope of the appended claims, even if not specifically recited. Thus, a combination of steps, elements, components, or constituents may be explicitly mentioned herein or less, however, other combinations of steps, elements, components, and constituents are included, even though not explicitly stated.

What is claimed is:

1. A method of making a magnesium alloy based object, the method comprising:

heating an object comprising a preliminary magnesium alloy at a first temperature for a first amount of time;

wherein the preliminary magnesium alloy comprises a first intermetallic phase having a melting temperature, a second intermetallic phase having a melting temperature, and an alloy phase having a solidus temperature;

wherein the melting temperature of the first intermetallic phase is lower than the melting temperature of the second intermetallic phase and the solidus temperature of the alloy phase;

wherein the melting temperature of the second intermetallic phase is higher than the solidus temperature of the alloy phase;

wherein the first temperature is from 10° C. to 50° C. above the melting temperature of the first intermetallic phase, below the melting temperature of the second intermetallic phase, and below the solidus temperature of the alloy phase; and wherein the first amount of time is from 10 to 15 hours;

thereby substantially dissolving the first intermetallic phase into the alloy phase to form an object comprising an intermediate magnesium alloy, the intermediate magnesium alloy comprising the second intermetallic phase and the alloy phase; and heating the object comprising the intermediate magnesium alloy at a second temperature for a second amount of time;

wherein the second temperature is from 10° C. to 20° C. above the melting temperature of the second intermetallic phase; and wherein the second amount of time is from 1 hour to 3 hours;

thereby substantially dissolving the second intermetallic phase into the alloy phase and minimizing incipient melting of the alloy phase to form the magnesium alloy based object.

2. The method of claim 1, wherein the second amount of time is from 1 hour to 2 hours.

3. The method of claim 1, wherein the preliminary magnesium alloy comprises a biocompatible magnesium alloy.

4. The method of claim 1, wherein the preliminary magnesium alloy comprises a Mg—Ca—Zn alloy or a Mg—Ca—Mn—Zn alloy.

5. The method of claim 1, wherein the first intermetallic phase comprises $Mg_6Ca_2Zn_3$.

6. The method of claim 1, wherein the second intermetallic phase comprises $Mg_2Ca$.

7. The method of claim 1, wherein the preliminary magnesium alloy is substantially free of rare earth elements.

8. The method of claim 1, further comprising thermomechanically treating the magnesium alloy based object by heating the magnesium based object at a third temperature for a third amount of time and, subsequently, mechanically treating the magnesium alloy based object, wherein the third temperature is above room temperature and below the solidus temperature of the alloy phase.

9. The method of claim 8, wherein the third temperature is from 10° C. to 50° C. below the solidus temperature of the alloy phase, the third amount of time is from 1 minute to 1 hour, or a combination thereof.

10. The method of claim 8, wherein mechanically treating the magnesium alloy based object comprises extrusion, forging, rolling, or a combination thereof the magnesium alloy based object.

11. The method of claim 8, further comprising repeating the thermomechanical treatment.

12. The method of claim 8, wherein the magnesium alloy based object exhibits improved yield stress and/or ductility after thermomechanical treatment.

13. The method of claim 1, wherein the first temperature is from 340° C. to 360° C.

14. The method of claim 1, wherein the second temperature is from 430° C. to 450° C.

15. The method of claim 1, wherein the magnesium alloy based object comprises a substantially homogeneous matrix comprising the alloy phase.

* * * * *